US011326385B2

(12) United States Patent
Dreyer et al.

(10) Patent No.: US 11,326,385 B2
(45) Date of Patent: May 10, 2022

(54) SLIDING DOOR ARRANGEMENT

(71) Applicant: ASSA ABLOY ENTRANCE SYSTEMS AB, Landskrona (SE)

(72) Inventors: Roger Dreyer, Bjarred (SE); Ivan Rajic, Lund (SE); Ola Ahlqvist, Harslov (SE)

(73) Assignee: Assa Abloy Entrance Systems AB, Landskrona (SE)

( * ) Notice: Subject to any disclaimer, the term of this patent is extended or adjusted under 35 U.S.C. 154(b) by 136 days.

(21) Appl. No.: 16/605,467

(22) PCT Filed: Apr. 23, 2018

(86) PCT No.: PCT/EP2018/060259
§ 371 (c)(1),
(2) Date: Oct. 15, 2019

(87) PCT Pub. No.: WO2018/197370
PCT Pub. Date: Nov. 1, 2018

(65) Prior Publication Data

US 2020/0123837 A1 Apr. 23, 2020

(30) Foreign Application Priority Data

Apr. 25, 2017 (SE) ..... 1730117-7

(51) Int. Cl.
*E05F 15/646* (2015.01)
*E06B 3/52* (2006.01)

(52) U.S. Cl.
CPC ..... *E05F 15/646* (2015.01); *E06B 3/52* (2013.01); *E05Y 2201/626* (2013.01);
(Continued)

(58) Field of Classification Search
CPC ..... E05F 15/646; E05F 15/638; E05F 1/04; E05F 1/043; E06B 3/52
See application file for complete search history.

(56) References Cited

U.S. PATENT DOCUMENTS 624,565 A 5/1899 Stewart
1,468,896 A 9/1923 Barker
(Continued)

FOREIGN PATENT DOCUMENTS

BE 1007862 11/1995
CH 711522 A2 * 3/2017 ..... E05D 15/565
(Continued)

OTHER PUBLICATIONS

International Search Report and Written Opinion mailed in PCT/EP2018/06059 dated Jul. 25, 2018.
Swedish Search Report mailed in 1730117-7 dated Nov. 23, 2017.

*Primary Examiner* — Marcus Menezes
(74) *Attorney, Agent, or Firm* — Wissing Miller LLP

(57) ABSTRACT

A door operating assembly (100) for operating a sliding door leaf (101) driven by a drive unit (112) along a sliding door rail (110), said door operating assembly (100) comprising a door bracket (150) configured to position the door leaf (101) relative the rail (110), a drive member (170) adapted to be driven by the drive unit (112), and a lever arm (160) having one end (161) pivotally connected to the drive member (170) and a remote portion (167) pivotally connected to the door bracket (150) via a cam structure (194) such that the vertical position of the door leaf (101) relative the rail (110) varies when the lever arm (170) pivots.

15 Claims, 3 Drawing Sheets

(52) U.S. Cl.
CPC ... *E05Y 2201/638* (2013.01); *E05Y 2201/652* (2013.01); *E05Y 2800/102* (2013.01); *E05Y 2800/12* (2013.01); *E05Y 2900/132* (2013.01)

(56) References Cited

U.S. PATENT DOCUMENTS

| | | | | | |
|---|---|---|---|---|---|
| 1,863,417 | A | | 6/1932 | Shonnard | |
| 2,458,402 | A | | 1/1949 | Myers | |
| 4,457,108 | A | * | 7/1984 | Kuschel | B60J 5/062 49/118 |
| 5,301,468 | A | * | 4/1994 | Kamezaki | E05D 15/1021 49/225 |
| 6,216,393 | B1 | * | 4/2001 | Apprich | E05F 15/638 49/212 |
| 2002/0053169 | A1 | * | 5/2002 | Menuzzo | E05D 15/565 49/360 |

FOREIGN PATENT DOCUMENTS

| | | | | | |
|---|---|---|---|---|---|
| DE | 1125310 | B | * | 3/1962 | E05D 15/1021 |
| DE | 1162718 | B | * | 2/1964 | E05F 15/646 |
| DE | 1272168 | B | * | 7/1968 | E05D 15/1021 |
| DE | 2616495 | A1 | * | 10/1977 | E05F 15/646 |
| DE | 3642746 | A1 | * | 12/1987 | E05F 15/638 |
| EP | 3112569 | A1 | * | 1/2017 | E05D 15/565 |
| FR | 3054261 | A1 | * | 1/2018 | E05F 15/646 |
| GB | 466466 | | | 5/1937 | |
| GB | 691330 | | | 5/1953 | |
| GB | 1197941 | | | 7/1970 | |
| GB | 2015066 | | | 9/1979 | |
| GB | 1572638 | | | 7/1980 | |
| GB | 1572638 | A | * | 7/1980 | E05F 15/646 |

* cited by examiner

SLIDING DOOR ARRANGEMENT

This application is a 371 of PCT/EP2018/060259 filed on Apr. 23, 2018, published on Nov. 1, 2018 under publication number WO 2018/197370, which claims priority benefits from Swedish Patent Application No. 1730117-7 filed on Apr. 25, 2017, the disclosure of which is incorporated herein by reference.

TECHNICAL FIELD

The present invention relates to a door operating assembly for operating a door leaf. More preferably the present invention relates to a door operating assembly for sliding doors and a sliding door assembly comprising said door operating assembly.

BACKGROUND

The use of automatic sliding doors is commonly known to facilitate access to buildings, rooms and other areas.

Conventional sliding doors are driven by a drive unit mounted at the door frame for driving a wagon along a rail via a driving belt. The wagon, in turn, is attached to the sliding door leaf, whereby the sliding door leaf is driven by the drive unit.

In some cases the sliding door serves as a barrier which in many cases requires a heavier door. Usage of sliding doors as sealing or hermetic barriers brings about several issues. Conventional sliding door arrangements may not provide a sufficient sealing effect in a closed position. However, if the sealing is too tight e.g. by the door leaf being pushed to tightly towards the sealing members of the door fame, the movement of the sliding door leaf is negatively affected due to the increased friction.

For providing appropriate closing of the sliding door the horizontal moving sequence, when approaching the closing end position, normally changes to a three-dimensional motion in which the sliding door not only moves the last horizontal distance, but also moves downwards and inwards, to close against the underlying ground or floor, as well as towards the frame. When opening the door the opposite motion is required.

This is conventionally achieved by providing a groove in the sliding track into which the carriage wheels of the door leaf can slide into, whereby the gravitation secures the sealing of the door while the groove provides a lifting motion or an outward directed motion of the door during the beginning of the opening cycle.

The force required to lift the door from the groove when the door needs to open naturally varies with the weight of the sliding door leaf. For example, in many cases a heavy sliding door is used, such as doors for an operation room or an X-ray room which may include a lead plate for shielding purposes causing, the door to weigh more than 400 kg. To lift such sliding doors from the groove an actuator is often required which leads to a more technically complex and expensive arrangement.

Usage of a special sliding track also requires specifically machined sections, since the position of the groove needs to be altered depending on the size of the sliding door leaf as well as on the desired sealing against the door frame. Hence, the production cost is increased and the sliding door assembly is limited to receive a sliding door of a specific size which prevents retrofitting.

It would therefore be beneficial to provide a solution allowing for retrofitting on existing sliding doors. It would also be beneficial to provide a solution which is less complex and does not require any additional actuator or power device to achieve the initial opening sequence of the sliding door.

SUMMARY

An object of the present invention is therefore to provide a solution to the above-mentioned problem, reducing the disadvantages of prior art solutions.

An idea of the present invention is to provide a door operating assembly for operating a sliding door leaf, the sliding door leaf being driven by a drive unit along a sliding door rail. The door operating assembly allows for an initial high torque during the beginning of an opening cycle of the sliding door leaf. The door operating assembly further allows for a reduction of the complexity of the associated door operating assembly. Furthermore, the door operating assembly allows for efficient sealing when the sliding door leaf is in a closed position, i.e. at the end of the opening cycle, and for retrofitting to existing sliding door arrangements.

The door operating assembly comprises a door bracket configured to position the door leaf relative the rail, a drive member adapted to be driven by the drive unit, and a lever arm. The lever arm having one end pivotally connected to the drive member and a remote portion pivotally connected to the door bracket via a cam structure such that the vertical position of the door leaf relative the rail varies when the lever arm pivots.

The lever arm may be connected to a door operating wagon being engaged with the sliding door rail in a sliding manner.

The door bracket may comprise a first portion extending along a part of the lever arm and a second portion adapted to be fixed to the door leaf, the door bracket being movable in relation to the lever arm.

The first portion may comprise a tilted surface, whereby the lever arm may comprise a tilted surface, the tilted surface of the first portion being slidable relative the tilted surface of the lever arm.

The drive member may be fixedly connected to a belt driven by the drive unit.

The cam structure may form an eccentric connection between the lever arm and the door bracket.

The door bracket may comprise a guiding pin being received by a groove of the cam structure, the cam structure being disposed on a substantially plate-shaped member of the lever arm.

The cam structure may comprise two end portions arranged at different radius from the centre of the remote portion of the lever arm.

At least one of said end portions may be arranged adjacent to a curved portion of the cam structure.

The lever arm may comprise a second end being connected to a hook-like member via a rod extending substantially parallel to the rail, the hook-like member being adapted to be retained against a fixed lip of the rail.

The rod may be tilted relative the rail for releasing the hook-like member from the lip, upon a pivot movement of the lever arm.

According to a second aspect of the invention a sliding door assembly is provided comprising a sliding door leaf, a drive unit and a sliding door rail. The drive unit being configured to drive the door leaf along the rail further comprising a door operating assembly according to the first aspect presented above.

The sliding door assembly may comprise at least two operating assemblies according to the first aspect presented above.

According to a third aspect of the invention a method for providing a sliding door assembly for operating a sliding door leaf driven by a drive unit along a sliding door rail is provided. The method comprising positioning the door leaf relative the rail by means of a door bracket, connecting a drive member to the drive unit and connecting the drive member to the door bracket by means of a lever arm having one end pivotally connected to the drive member and a remote portion pivotally connected to the door bracket via a cam structure such that the vertical position of the door leaf relative the rail varies when the lever arm pivots.

According to a fourth aspect of the invention a method for operating a sliding door leaf driven by a drive unit along a sliding door rail is provided. The method comprises providing a door operating assembly according to the first aspect presented above, and driving the door leaf between an open and closed position, whereby in the open position the lever arm is pivoted such that the door leaf is raised vertically, and in the closed position the lever arm is pivoted such that the door leaf is lowered vertically

BRIEF DESCRIPTION OF THE DRAWINGS

Embodiments of the invention will be described in the following; reference being made appended drawings which illustrate non-limiting examples of how the inventive concept can be reduced into practice.

DETAILED DESCRIPTION OF THE EMBODIMENTS

Figure 1:
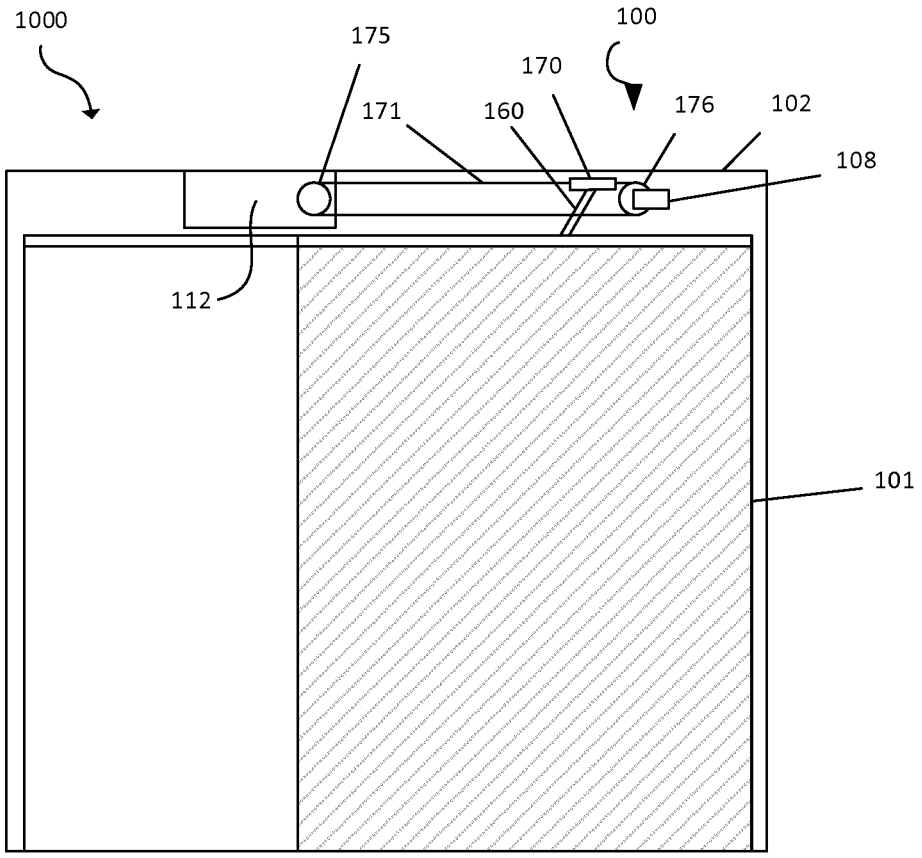
FIG. 1 is a front view of a sliding door assembly comprising a door operating assembly according to one embodiment.
Figure 2:
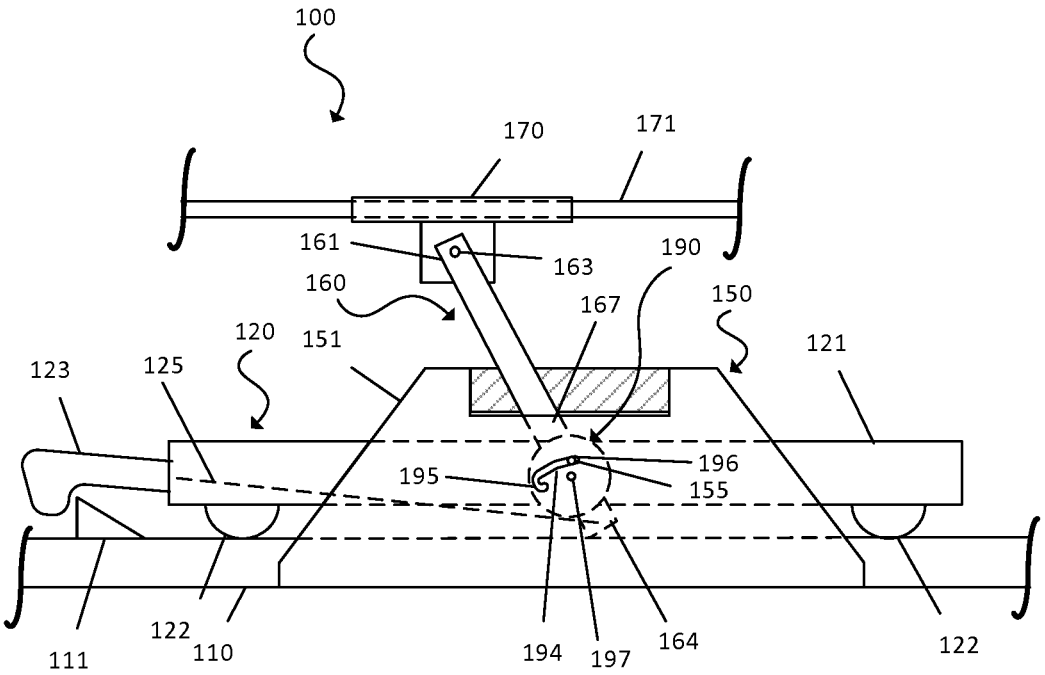
FIG. 2 is a front view of a door operating assembly according to one embodiment, for use e.g. with the sliding door assembly of FIG. 1.

An example of a door operating assembly 100 will be described in the following. With reference to FIGS. 1 and 2 a sliding door assembly comprises a sliding door leaf 101, a drive unit 112, a sliding door rail 110, and a door operating assembly 100 for driving the sliding door leaf 101. The sliding door leaf 101 is driven by the drive unit 112 along the sliding door rail 110 which is fixed relative a door frame 102.

The door leaf 101 may be made of wood, metal, plastic, glass or other suitable materials. The door leaf 101 may also be a fire proof door having a fire resistant core made of various suitable materials generally known in the art. Fire resistant door leafs are typically constructed to prevent or delay transfer of thermal energy, i.e. heat, from one side of the door leaf 101 to the opposite side 101. Due to its construction these door leafs 101 are often comparatively heavy.

Figure 3:
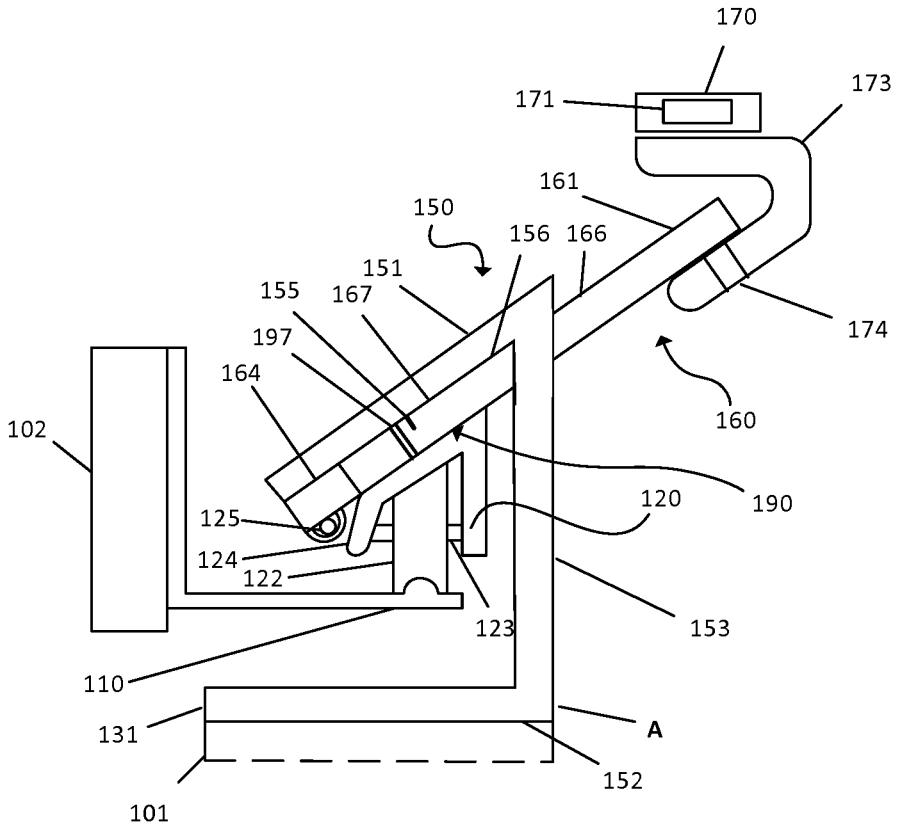
FIG. 3 is a cross-sectional view of the door operating assembly shown in FIG. 2 when in a first position corresponding to a closed position of an associated door leaf.
Figure 4:
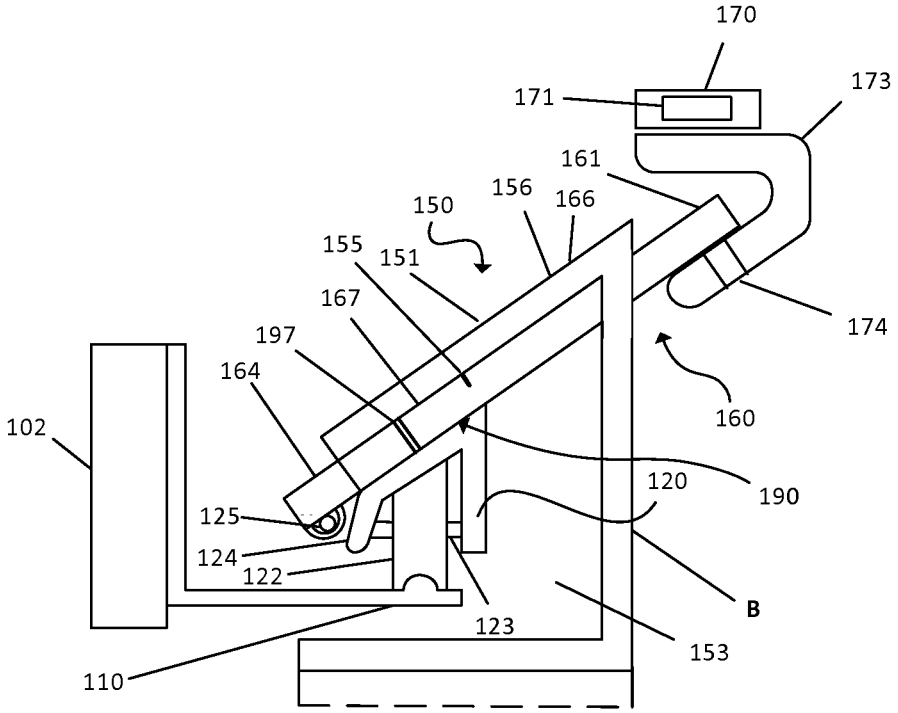
FIG. 4 is a cross-sectional view of the door operating assembly shown in FIG. 2 when in a second position corresponding to an open position of an associated door leaf.

The door leaf 101 is slidingly connected to the sliding door rail 110 for example by means of a trolley or wagon 120 (see FIGS. 2-4). The wagon 120 is preferably engaging with the sliding door rail 110 via a set of low friction wheels 122 (see FIGS. 3-4) allowing the sliding door leaf 101 to move into a closed and open position along the horizontal sliding door rail 110.

Several applications for an automated sliding door assembly require the sliding door leaf 101 to serve as a barrier minimizing any transfer of mediums between the rooms separated by the sliding door assembly. For such applications the sliding door leaf 101 may be provided with sealings adapted to be pushed against the door frame 102 and/or the ground when the sliding door leaf 101 is in a closed position.

Further referring to FIG. 1, the sliding door assembly comprises a drive unit 112 which may be of any conventional type. Typically, the drive unit 112 comprises an electric motor and a reduction gearing providing the necessary torque to move the sliding door leaf 101 between the open and closed position. According to the present example a belt drive arrangement connects the drive unit 112 with a drive member 170. Advantageously, the drive unit 112 is adapted to be connected to the door frame 102 of the sliding door assembly, or even mounted within the interior of the upper part of the door frame 110.

The drive member 170 is fixedly connected to a belt 171 driven by the drive unit 112. The drive member 170 may e.g. be provided as a clamping structure attached to the drive belt 171. The drive belt 171 is preferably a synchronous endless drive belt extending between two driving wheels 175 and 176. The driving wheel 175 is directly driven by the drive member 112 and the second driving wheel 176 is rotationally supported by a console 108 being fixed to the door frame 102.

Due to the weight of the sliding door leaf 101 as well as the friction in the contact between the sliding door leaf 101 and the floor or door frame 102, a relatively large torque is required to initiate the movement of the sliding door leaf 101 from a closed position, i.e. when the door leaf 101 is urged to move to the left in FIG. 1. This is especially the case when the door leaf 101 is vertically lowered in the closed position as explained above. Normally such large torque cannot be provided with a conventional drive unit 112 without severely reducing the speed of which the door leaf 101 can move between an opened and closed position.

To enable the provision of the additional torque without requiring an additional actuator a door operating assembly 100 is provided. As will be explained in the following the door operating assembly 100 comprises a lever arm 160 and a door bracket 150.

As can be seen in FIG. 1 the lever arm 160 connects the door leaf 101 to the drive member 170.

Now turning to FIG. 2, the door bracket 150 is configured to position the door leaf 101 relative the rail 110. One end 161 of the lever arm 160 is pivotally connected to the drive member 170 and a remote portion 167 of the lever arm 160 is pivotally connected to the door bracket 150. The movement away from the door frame and/or the ground is accomplished by the remote portion 167 being pivotally connected to the door bracket 150 via a cam structure 194 such that the vertical position of the door leaf 101 relative the rail 110 varies when the lever arm 170 pivots. Thus, the lever arm 160 enables lifting of the sliding door leaf 101 in the beginning of the opening cycle via the door bracket 150 as the pivoting motion of the lever arm 160 follows the cam structure 194. As the door bracket 150 is supporting the door leaf 101 the additional torque required for lifting the door leaf 101 is provided. The door operating assembly 100 thereby allows for the sliding door leaf 101 to be moved upwards when the lever arm 160 pivots in one direction (to the right in FIG. 2), and downwards when the lever arm 160 pivots back to its position of FIG. 2. Thereby the sliding door leaf 101 may rest on its own weight against the ground or door frame 102 in the closed position while no additional actuator is required to lift the sliding door leaf 101 in the beginning of the opening cycle.

Comparing to existing mechanical solutions utilizing a depressed section at the rail 110 for allowing for a tighter sealing, the herein described operating assembly 100 notably does not require a specific guiding structure which needs to be unique for each available size of sliding door leafs 101.

Hence, a non-complex and more cost-efficient door operating assembly which allows for retro-fitting on existing sliding door leaf assemblies as well as implementation independently of the dimensions of the sliding door leaf is obtained.

Further referring to FIG. 2, the lever arm 160 is connected to the wagon 120 in sliding engagement with the door rail 110, e.g. by means of the wheels 122. The lever arm 160 is connected to the wagon 120 via a pivot connection 197, preferably arranged in the centre of the remote portion 167 of the lever arm 160.

Turning to FIGS. 3 and 4 a door operating assembly 100 being in a first position A respectively a second position B is shown, the first position A corresponding to a closed position of the sliding door leaf 101 and the second position B corresponding to an elevated position of the sliding door leaf 101, i.e. an opened position of the sliding door leaf 101.

As seen in the door bracket 150 is arranged to move from the first position A where the sliding door leaf 101 is in its lowered position to the second position B upwardly and outwardly from the door frame 102 when the lever arm 160 pivots.

The upwards/outwards movement is allowed by arranging the lever arm 160 in a tilted manner as can be seen in FIGS. 3-4.

The upper end 161 of the lever arm 160 is pivotally connected to a drive member bracket 173 via a pivoting connection 174, the drive member bracket 173 having a tilted surface abutting to said end 161.

The door bracket 150 comprises a first portion 151 extending along a part of the lever arm 160 and a second portion 152 adapted to be fixed to the door leaf 101. The door bracket 150 is movable in relation to the lever arm 160 by allowing the first portion 151 to slide relative the lever arm 160. The door bracket 150 also comprises a third intermediate portion 153 connecting said first and second portions 151, 152. The third intermediate portion 153 may, with reference to FIGS. 3 and 4, extend in a substantially vertical direction, while the second portion 152 may extend in a substantially horizontal direction.

The door bracket 150 is movable in relation to the lever arm 160 by means of a tilted surface 156 of the first portion 151 being slidable relative a tilted surface 166 of the lever arm 160. The inclination of the tilted surfaces 156, 166 thus defines the direction of movement of the door bracket 150 and thereby the direction of movement of the sliding door leaf 101 in the beginning and the end of the opening cycle, i.e. when the lever arm 160 pivots. Thus, the door operating assembly 100 may enable the sliding door leaf 101 to move in a direction extending outwardly as well as upwardly from its initial closed position. Accordingly, a non-complex door operating assembly 100 which allows a tight sealing towards the door frame 102 as well as the ground when the sliding door leaf 101 is in a closed position is obtained.

Still referring to FIGS. 3 and 4 the door bracket 150 comprises a guiding pin 155 being received by a groove of the cam structure 194. The cam structure 194 is disposed on a substantially plate-shaped member 190 of the lever arm 160. The plate-shaped member 190 may have a substantially circular shape and it may have a centre coinciding with the centre of the remote portion 167.

To provide the moving of the door bracket 150 in relation to lever arm 160 the cam structure 194 forms an eccentric connection between the lever arm 160 and the door bracket 150. The eccentric connection is further described with reference to FIGS. 5 and 6.

Figure 5:
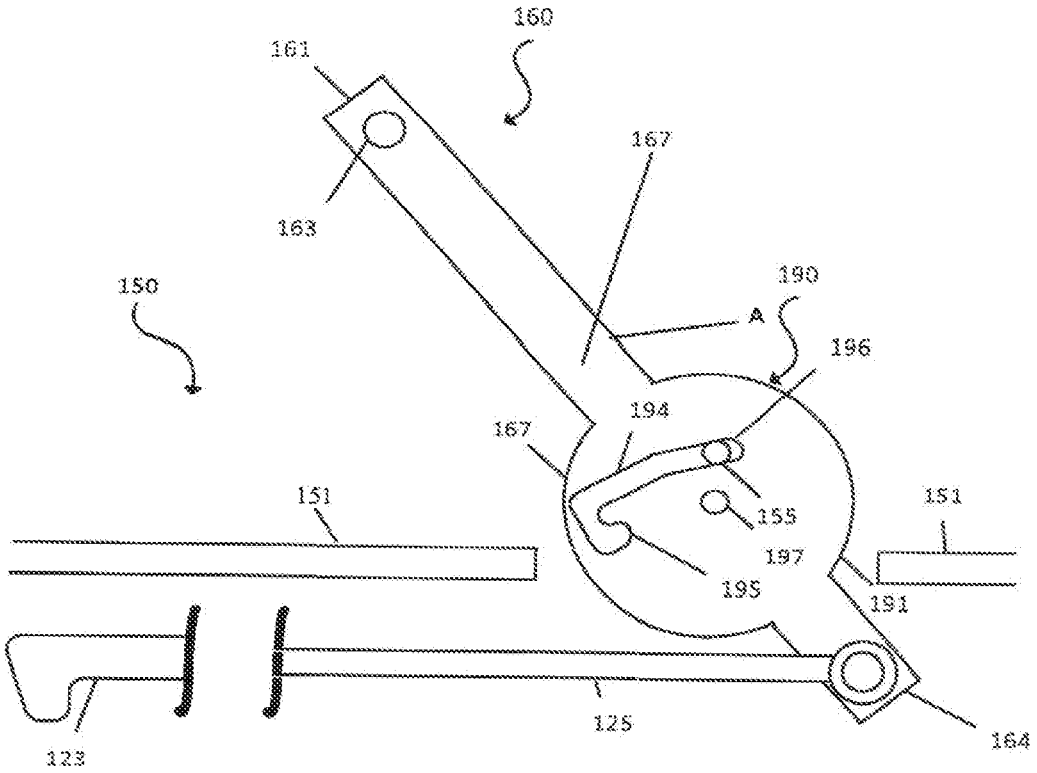
FIG. 5 is a front view of a lever arm of the door operating assembly when in the first position.
Figure 6:
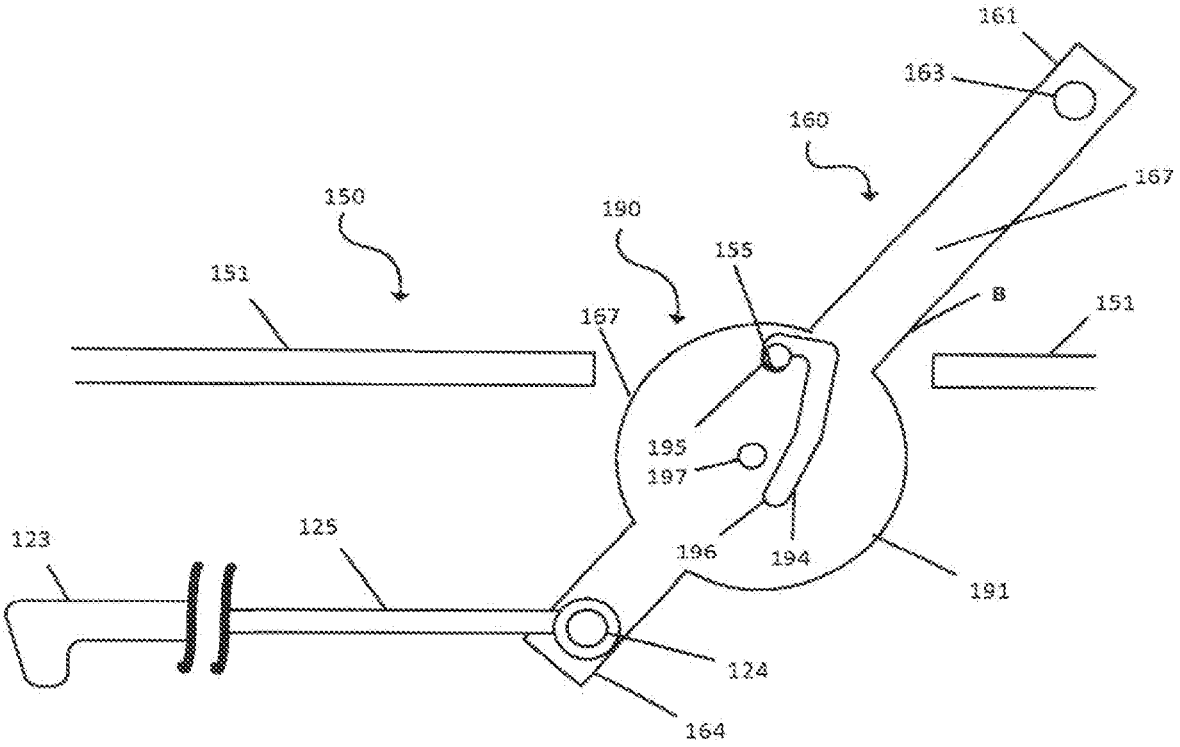
FIG. 6 is a front view of the lever arm of the door operating assembly when in the second position.

Referring to FIGS. 5-6 the lever arm 160 of the door operating assembly 100 is further depicted. The door operating assembly 100 is in FIG. 5 arranged in the first position A, while in FIG. 6 the door operating assembly is arranged in the second position B.

The cam structure 194 comprises two end portions 195, 196 arranged at different radius from the pivot point 197 of the remote portion 167 of the lever arm 160. One of the end portions 195, 196 is arranged adjacent to a curved portion of the cam structure 194. The cam structure 194 may thus be in the form a groove machined into the plate-shaped member receiving the guiding pin 155, whereby the guiding pin controls the sliding connection between the door bracket 150 and the lever arm 150.

One of the end portions 195, 196 provides an end point to the pivoting movement of the lever arm 160, thereby locking the position of the door bracket 150 under the remaining portion of the opening cycle until the horizontal movement of the sliding door leaf 101 is hindered by for example a stop, which may be in the form of a stop disposed along the sliding door rail 110 or in form of the door frame 102.

The torque will then serve to pivot the lever arm 160 back to the position it has in position A and force the guiding pin 155 towards the end position 196 from the end position 195. Thus, the door bracket 150 is forced to move downwards and inwards thereby sealing the door leaf 101 towards the ground and the door frame 102.

Vice versa, the torque provided to the lever arm 160 in the beginning of the opening cycle will first force the lever arm 160 to pivot which forces the guiding pin 155 to move from the end portion 196 to the end portion 195. Consequently, the door bracket 150 is retained and the torque instead serves to move the sliding door leaf 101 horizontally.

With the above described eccentric connection a door operating assembly 100 which enables a substantially a movement solely vertically and in depth in the beginning and end of the opening cycle and a straight horizontal movement in the remaining opening cycle is provided, which allows for a more robust operating assembly.

The eccentric connection further allows for controlling the closing movement so as to not allow the end position 196 to be reached by the guiding pin 155 during the end of the opening cycle. This is achieved by controlling the drive unit 112 to stop the horizontal driving of the drive member 170 prior to the fully closed end position. Hence, the door bracket 150 is not allowed to move the sliding door leaf 101 to a fully sealing position. Thereby, a faster motion of the sliding door leaf 101 is enabled, which may be advantageous when the door is subjected to numerous prompted opening cycles during a limited period of time. An application for a configuration allowing said faster movement may for example be a sliding door arrangement in a shop where the speed of the opening cycle may be prioritized before sealing efficiency during opening hours. During closing hours however, the drive unit 112 may be controlled so as to achieve sufficient sealing.

Again referring to FIGS. 5 and 6 as well as FIG. 1, the aforementioned stopping feature may be constituted by a retention arrangement coupled to the lever arm 160 according to the following. The lever arm 160 may comprises a second end 164 being connected to a hook-like member 123 via a rod 125 extending substantially parallel to the rail 110. Preferably, the rod 125 is connected to the end 164 of the lever arm 160 via a pivot connection 124. The hook-like member 123 is adapted to be retained against a fixed lip 111 of the rail 110. Thereby, the sliding door leaf 101 is held in a sealing manner without requiring any complex moving parts.

Advantageously, the rod 125 may upon a pivot movement of the lever arm 160 be tilted relative the sliding door rail 110 for releasing the hook-like member 123 from the lip 111.

The retention arrangement further allows for a tighter sealing since the positioning of the lever arm 160 when the sliding door leaf 101 is in a closed position applies a contact force between the hook-like member 123 and the lip 111 holding the door leaf 101 in position. Any tilting of the lever arm 160 in the other direction causes the hook-like member 123 to disengage from the lip 111 and be lifted due to the connection to the lever arm 160, whereby the sliding door leaf 101 is movable once again.

The lip 111 may for example be disposed along the sliding door rail 111, preferably being connected to the frame 102 or the sliding door rail 111.

According to the above description a sliding door assembly is provided. The sliding door assembly comprises a sliding door leaf 101, a drive unit 112, and a sliding door rail 110, the drive unit 112 being configured to drive the door leaf 101 along the rail 110. The sliding door assembly 1000 further comprises a door operating assembly 100 according to any of the previously described embodiments. Thus, a sliding door assembly with a more efficient sealing can be provided. Furthermore, it allows for a sliding door assembly which is cheaper to manufacture since the operating mechanism does not require adjustments depending on the size of sliding door leafs.

Preferably, the sliding door assembly 1000 may comprise at least two door operating assemblies according to any of the previously described embodiments. Thus, the sliding door leaf 101 is suspended in a more balanced manner, resulting in a more robust and reliable sliding door assembly. Furthermore, having at least two door operating assemblies increases the retro-fitting capability further, since the door operating assembly to a lower extent have to be dimensioned for a specific door type since additional door operating assemblies help distributing the load of the weight of the sliding door leaf.

According to another aspect of the invention a method for providing a sliding door assembly for operating a sliding door leaf 101 driven by a drive unit 112 along a sliding door rail 110 is provided. The method advantageously comprises positioning the door leaf 101 relative the rail 110 by means of a door bracket 150, connecting a drive member 170 to the drive unit 112 and connecting the drive member 170 to the door bracket 150. In accordance with the aforementioned embodiments, the drive member 170 is connected to the door bracket 150 by means of a lever arm 160 having one end 161 pivotally connected to the drive member 170 and a remote portion 167 pivotally connected to the door bracket 150 via a cam structure 194 such that the vertical position of the door leaf 101 relative the rail 110 varies when the lever arm 170 pivots.

Thus, a less costly and less complex method for providing a sliding door assembly is obtained, since it does not require any fitting of additional actuators or mechanical solutions which require individual alterations for each desired size of door leaf.

According to yet another aspect of the invention a method for operating a sliding door leaf 101 driven by a drive unit 112 along a sliding door rail 110 is provided. The method preferably comprises providing a door operating assembly according to any of the previously described embodiments, as well as driving said drive unit 112 between an open and closed position, whereby in the open position the lever arm 160 is pivoted such that the door leaf 101 is raised vertically, and in the closed position the lever arm 160 is pivoted such that the door leaf 101 is lowered vertically. Thus, the door is lifted in the beginning of the opening cycle, allowing for less friction against the sealings whereby an additional actuator may not be required, which in turn leads to a less complex operating method which still provides sufficient sealing when the door is in the closed position.

It should be appreciated that even though numerous characteristics and advantages of the present invention have been set forth in the foregoing description, together with details of the structure and function of the invention, the description is only illustrative and changes may be made in detail, especially in matters of shape, size and arrangement of parts within the scope of the invention to the full extent indicated by the appended claims

The invention claimed is:

1. A door operating assembly for operating a sliding door leaf driven by a drive unit along a sliding door rail, the door operating assembly comprising:

a door bracket configured to position the door leaf relative the rail;

a drive member adapted to be driven by the drive unit; and a lever arm having one end pivotally coupled to the drive member and a remote portion pivotally connected to the door bracket via a cam structure such that a vertical position of the door leaf relative the rail varies when the lever arm pivots, wherein the door bracket comprises a guiding pin that is received by a groove in the cam structure, and wherein the guiding pin is configured to travel from one end position of the groove to another end position of the groove as the lever arm pivots.

2. The door operating assembly according to claim 1, wherein the lever arm is connected to a door operating trolley engaged with the sliding door rail in a sliding manner.

3. The door operating assembly according to claim 1, wherein the door bracket comprises a first portion extending along a part of the lever arm and a second portion adapted to be fixed to the door leaf, the door bracket being movable in relation to the lever arm.

4. The door operating assembly according to claim 3, wherein the first portion comprises a tilted surface, the lever arm comprises a tilted surface, and wherein the tilted surface of the first portion is slidable relative the tilted surface of the lever arm.

5. The door operating assembly according to claim 1, wherein the drive member is fixedly connected to a belt driven by the drive unit.

6. The door operating assembly according to claim 1, wherein the cam structure forms an eccentric connection between the lever arm and the door bracket.

7. The door operating assembly according to claim 1, wherein the cam structure being disposed on a substantially plate-shaped member of the lever arm.

8. The door operating assembly according to claim 7, wherein the cam structure comprises two end portions arranged at different radius from the centre of the remote portion of the lever arm.

9. The door operating assembly according to claim 8, wherein at least one of said end portions is arranged adjacent to a curved portion of the cam structure.

10. The door operating assembly according to claim 1, wherein the lever arm comprises a second end being connected to a hook member via a rod extending substantially parallel to the rail, the hook member being adapted to be retained against a fixed lip of the rail.

11. The door operating assembly according to claim 10, wherein the rod, upon a pivot movement of the lever arm, is tilted relative the rail for releasing the hook member from the lip.

12. A sliding door assembly comprising:

a sliding door leaf;

a sliding door rail;

a drive unit configured to drive the door leaf along the door rail; and a door operating assembly comprising:

a door bracket configured to position the door leaf relative the door rail;

a drive member adapted to be driven by the drive unit; and a lever arm having one end pivotally coupled to the drive member and a remote portion pivotally connected to the door bracket via a cam structure such that a vertical position of the door leaf relative the rail varies when the lever arm pivots, wherein the door bracket comprises a guiding pin that is received by a groove in the cam structure, and wherein the guiding pin is configured to travel from one end position of the groove to another end position of the groove as the lever arm pivots.

13. The sliding door assembly according to claim 12, the sliding door assembly comprising at least two of the door operating assemblies.

14. A method for providing a sliding door assembly for operating a sliding door leaf driven by a drive unit along a sliding door rail, the method comprising:

positioning the door leaf relative the rail by means of a door bracket;

connecting a drive member to the drive unit; and connecting the drive member to the door bracket by means of a lever arm having one end pivotally connected to the drive member, and a remote portion pivotally connected to the door bracket via a cam structure such that a vertical position of the door leaf relative the rail varies when the lever arm pivots, wherein the door bracket comprises a guiding pin that is received by a groove in the cam structure, and wherein the guiding pin is configured to travel from one end position of the groove to another end position of the groove as the lever arm pivots.

15. A method for operating a sliding door leaf driven by a drive unit along a sliding door rail, the method comprising:

positioning the door leaf relative the rail by means of a door bracket;

connecting a drive member to the drive unit; and connecting the drive member to the door bracket by means of a lever arm having one end pivotally connected to the drive member, and a remote portion pivotally connected to the door bracket via a cam structure such that a vertical position of the door leaf relative the rail varies when the lever arm pivots, wherein the door bracket comprises a guiding pin that is received by a groove in the cam structure, and wherein the guiding pin is configured to travel from one end position of the groove to another end position of the groove as the lever arm pivots; and driving said door leaf between an open and closed position, whereby in the open position the lever arm is pivoted such that the door leaf is raised vertically, and in the closed position the lever arm is pivoted such that the door leaf is lowered vertically.

* * * * *